US005597256A

United States Patent [19]

Burton et al.

[11] Patent Number: 5,597,256

[45] Date of Patent: Jan. 28, 1997

[54] INSERT FOR LOOSE-LEAF BINDER

[76] Inventors: Joseph D. Burton, 572 Center St., Salt Lake City, Utah 84103-1722; Stephen P. Vuyk, 3898 W. Holyoke Pl., South Jordan, Utah 84095; Steven C. Hatch, 2943 S. Farah Dr., Salt Lake City, Utah 84118

[21] Appl. No.: 177,427

[22] Filed: Jan. 5, 1994

[51] Int. Cl.[6] ..... B42F 13/20

[52] U.S. Cl. ..... 402/4; 402/79; 402/80 P; 402/80 R; 281/38

[58] Field of Search ..... 402/79, 80 P, 80 L, 402/80 R, 500, 501, 4; 281/38

[56] References Cited

U.S. PATENT DOCUMENTS

| | | | |
|---|---|---|---|
| 792,747 | 6/1905 | Anderson et al. | 402/79 X |
| 1,371,459 | 3/1921 | Amlie | 402/79 |
| 1,533,442 | 4/1925 | Meyer et al. | 402/501 |
| 1,548,248 | 8/1925 | Binns et al. | 281/43 X |
| 1,804,514 | 5/1931 | Riddiford | 402/500 X |
| 3,125,813 | 3/1964 | Schade | 281/38 X |
| 3,734,155 | 5/1973 | Stenger . | |
| 3,776,648 | 12/1973 | Price . | |
| 3,936,201 | 2/1976 | Kenney et al. | 402/80 L X |
| 4,240,761 | 12/1980 | Jacobson . | |
| 4,516,871 | 5/1985 | Leitman . | |
| 4,571,867 | 2/1986 | Williams . | |
| 4,795,287 | 1/1989 | Friedman . | |
| 4,848,948 | 7/1989 | Pitts . | |
| 4,925,720 | 5/1990 | Hansen | 402/79 X |
| 4,954,003 | 9/1990 | Shea | 281/31 X |
| 4,961,666 | 10/1990 | Pitts et al. . | |
| 4,964,508 | 10/1990 | Balsley | 281/31 X |
| 5,104,167 | 4/1992 | Nemeth | 281/45 X |
| 5,340,156 | 8/1994 | Bianco | 281/31 X |

FOREIGN PATENT DOCUMENTS

| | | | |
|---|---|---|---|
| 816249 | 10/1951 | Germany | 402/20 |

OTHER PUBLICATIONS

Copy of Acme United Corporation Plastic Ruler and Hang Tag.

*Primary Examiner*—Frances Han

*Attorney, Agent, or Firm*—A. John Pate; Berne S. Broadbent; Gary D. E. Pierce

[57] ABSTRACT

An insert for a loose-leaf binder is provided with a perforation near one inside corner at a proximal end of the insert to receive one ring of a loose-leaf binder. The insert is thus positioned with respect to the rings of the binder, and retained by the one ring. In one embodiment, the insert is provided with a slot formed along the inside edge of the insert to receive at least one other ring of the binder. A first web between the perforation and the slot has a length less than the distance between adjacent rings of the binder. A second web at a distal end of the insert is sized likewise to fit between adjacent tings of the binder. Upon insertion into a binder and securement by the tings thereof, the insert holds the tings in the perforation and the slot. The perforation can be positioned to receive any ting, while the slot receives one or several adjacent tings within the length of the slot. In an alternate embodiment a fixed tab attached to an inside corner of the insert at the proximal end thereof receives a first ting, and a moveable tab sliding along a rib attached to the inside edge of the insert is perforated to receive a second ting. Multiple moveable tabs can be attached to slide along the rib attached to the insert.

14 Claims, 10 Drawing Sheets

INSERT FOR LOOSE-LEAF BINDER

BACKGROUND OF THE INVENTION

1. Field of the Invention

The invention pertains to the field of accessories for insertion and retention in loose-leaf binders and more particularly to a panel having a perforation pattern insertable in a loose-leaf binder regardless of the number and configuration of retaining tings or their positions along the length of the binder.

2. State of the Art

Loose-leaf binders are typically comprised of a binding having a back panel or spine attached between a front panel and a rear panel as viewed in a closed position by a user. The principal component of a loose-leaf binder, best viewed with the binder in an open position, is a set of selectively closeable and openable tings, rods or tabs, all of which are here called retainers. That is, split rings selectively openable, spreadable tabs, and rods so, cured to brackets and shaped to receive caps at one end are some of the various mechanism employed to retain loose leaves in a loose-leaf binder.

The retainers are distributed along the length of the binder near the spine. Retainers may be secured to a clamping mechanism attached by a suitable fastener to the back panel, in the ease of closeable tings, or may be a row of posts or rods extending away from the rear panel to meet capping sleeves extending away from the front panel of the binder. Various shapes and attachment schemes as well as locations exist in the art for loose-leaf-type binders. Thus, one may refer to the retainers as rings, the most common type of retainer, or as retainers. In any event, the meaning herein of any retainer, ring or rod is inclusive of all other retainer types capable of retaining perforated leaves in a binder.

Each retainer penetrates one of several perforations formed in each loose leaf inserted into the binder. Binders are formed to have two, three, five, six, seven and sometimes dozens of retainers. Because of the multiplicity of retainer configurations, and the standardization of sizes and placement of retainers, binders are sometimes referred to by the capacity of thickness of leaves and the standard number or configuration of retainers. For example, one may speak of "three-ring" binders, "three-inch three-ring" binders, "two-post lay-flat" binders, or "two-inch three-ring D-ring" binders and so forth.

Although the three-ring binder is commonly used to store papers which may be removed periodically, many other binder types are also significant. Additional rings or retainers typically are used when greater manipulation over a longer time is likely. For example, in planners or day books additional rings help to secure leaves of paper or other accessories against being tom out during the greater manipulation experienced over a month or a year as leaves are turned forward and backward many times per day.

The paper industry serves its markets by producing leaves of paper for each size and configuration of binder. The dimensions of leaves, and thus of binders, may vary widely. For example, eight and one half by eleven inch paper is a standard size, and binders for holding it are often described by this paper size. Likewise, five and one half by eight and one half inch paper is also a standard size. Different manufacturers of specialty binders may choose a size and format to meet specific needs. Manufacturers sometimes customize a binder configuration purposely, to satisfy a specific purpose or simply to prevent the use of any standardized product in the binder. That is, only the leaves provided by the manufacturer of the binder will fit into the binder.

The great difficulty presented by the variety of binder configurations arises with respect to accessories. Typical accessories may include a pencil pouch, a photograph pocket or credit card holder. Accessories are often particularized to a profession or industry and, unlike paper leaves, may or may not be produced by the manufacturer of the binder. Thus, a manufacturer of accessories may find it extremely inconvenient, and perhaps impossible, to produce accessories with a perforation pattern that will fit all conceivable binder configurations.

This dilemma appears most acutely in day books. Day books may become central to the functioning of a user, being configured to maintain not only the user's dally schedule, but also a host of paraphernalia associated with the user's daily routine. One can easily see that a calculator or small computer, a ruler, a data sheet and a pocket of some variety may be considered vital to one who carries all the appurtenances of his or her professional life in a daybook.

That is, a single binder containing all the commonly desired accessories peculiar to one's daily work is preferable to a multiplicity of cases and binders containing the various accessories. Something is often left out or left behind, or just too inconvenient to access. On the contrary, having all key accessories in one binder would be convenient and secure. One need only remember to take the binder, knowing that the accessories are present therein.

The manufacturers of accessories who have wrestled with the variety of binder configurations usually manufacture different sizes of leaves, all standardized. The manufacturers of binders usually produce a variety of accessories uniquely sized to their own selection of binders. Few manufacturers of binders or accessories have addressed the issue of producing a universal leaf for insertion into a variety of binder sizes and shapes. As calculators and small computers become thinner, solar powered, and ubiquitous, a holder for them becomes more desirable.

A durable insert for securing a calculator in a loose-leaf binder while permitting ready removal or attachment on demand is needed. The insert should fit the widest possible variety of binder configurations, and should be adaptable to a variety of computers. Once a universal pattern for fitting in a wide variety of binders is created, it may be adapted to many types of accessories commonly desirable to be carded in a loose-leaf binder.

SUMMARY

An insert for a loose-leaf binder is provided with a perforation near one inside corner at a proximal end of the insert to receive one ring of a loose-leaf binder. The insert is thus positioned with respect to the tings of the binder, and retained by the one ring. In one embodiment, the insert is also provided with a slot formed along the inside edge of the insert to receive at least one other ring of the binder. The slot creates a rib separated from the main panel of the insert. A first web connects the main panel of the insert near the proximal end thereof to the rib positioned inwardly from of the slot. A second web connects the rib to the main panel at the distal end of the insert. The first web between the perforation and the slot has a length less than the distance between adjacent rings of the binder. The third web connecting the panel to the rib at the distal end of the insert is sized likewise to fit between adjacent rings of the binder.

Upon insertion into a binder and securement by the rings thereof, the insert captures at least two the rings in the perforation and the slot. The perforation can be positioned to receive any ring, while the slot receives one or several adjacent rings within the length of the slot. In an alternate embodiment a fixed tab attached to an inside corner (relative to an open binder) of the insert at the proximal end thereof receives a first ring, and a moveable tab sliding along a rib attached to the inside edge of the insert is perforated to receive a second ring. Multiple moveable tabs can be attached to slide along the rib attached to the insert.

The invention is an insert for a loose-leaf binder of the type having a plurality of retainers, also called rings, tabs or posts depending on the configuration. Retainers are disposed along the length of the binder. The retainers are arranged proximate the spine to be selectively openable for receiving loose leavesessories and the like. The retainers are selectively closable and lockable to retain the loose leaves.

The insert may be configured to be a holder for some other useful accessory, article or object. The insert may be made a holder for or integral to a variety of accessories. Accessories may include a pencil pouch, photograph pocket, credit card holder, computer diskette holder, business card holder, dry-erase board, checkbook, data reference sheet, ruler, electronic appointment book, personal digital assistant, calculator, a computer, another microprocessor-based accessory or conceivably a cellular phone or other technological tool.

The insert comprises principally a panel shaped to present a front surface to a user. The surface may be any suitable shape, but a rectangular configuration may be widely useful. The panel extends away from the rings of the loose-leaf binder. A rib is secured at a first end to a first edge of the panel by a first web. The first web is positioned proximate one end of the panel. The rib is secured at a second end to the first edge of the panel by a second web. The second web is positioned proximate the other end of the panel. A slot is formed to extend between the first web and the second web and between the rib and the first edge of the panel. The slot is configured to receive rings of the binder.

In one embodiment, a third web extends between the rib and the first edge of the panel to form an aperture between the second and third webs. The aperture is sized to receive a single ring of the binder.

In one embodiment, the portion of the insert containing the slot and aperture folds into the body of the accessory during use. In yet another embodiment, that portion of the insert may slide into the panel of the insert or may detach along a zippered or otherwise connected linear interface.

The insert is comprised of a stiff material. The stiff material may include a metal. For example, the insert may be formed of a sheet of stainless steel. Alternatively, the insert may be reinforced along the rib by a backing of metal clamped against the sides thereof.

In one embodiment the insert is comprised of a flexible material. Appropriate materials may be merely flexible enough to tolerate bending under loading, in order to prevent breakage, such as many high density polymers are, or may by limp such as vinyl films are. Thus, the material may be stiff and not flexible, stiff and flexible or flexible and not stiff, depending on the specific application of the insert.

The insert in one embodiment comprises a securement structure attached to a surface thereof to receive and retain an object. For example, the object may be a computer or calculator. In one embodiment, the securement structure includes a hook and loop material. The hook portion of the material is fixedly attached to the computer and the loop portion of the material is attached to the insert. A stiff insert is preferable in this application, although the material must be sufficiently flexible to resist breakage. Whenever the computer is set on the insert, the hooks and loops engage to hold the computer securely against the insert. The computer is removed from the insert by tugging it away from the insert, disengaging the hooks and loops. Thus, the computer may be used in the binder, separated from the insert for use or separated with the insert from the binder.

In one embodiment, the insert includes a pocket. In another embodiment, the insert includes a plurality of pockets. Pockets are sized for holding useful articles such as photographs, business cards, computer diskettes and so forth.

The invention may be regarded as an accessory for a binder of the type having elongate retainers spaced apart and sized to retain loose leaves by penetrating apertures therein. The accessory comprises a panel having a first surface bounded by a top edge, a bottom edge, an inside edge and an outside edge. The panel is perforated proximate a vertex formed by the bottom edge and the inside edge to receive a first retainer. The panel is also perforated to receive a second retainer spaced away from the first retainer an arbitrary distance less than the length of the panel. In the preferred embodiment, the insert is perforated to form a slot extending the length of the panel less the diameter of the aperture and the lengths of the three webs necessary to close the aperture and the slot.

The opening of the slot is preferably continuous along the length of the panel, the slot being positioned proximate the inside edge of the panel to receive a second retainer spaced away from the first retainer. The relative lengthwise positions of the slot and aperture may be reversed. Also, the inside edge may be the right or left side of the panel.

The accessory includes an attachment structure for securing an object to the first surface. For example, the attachment structure is configured to hold a computer against the first surface. For example, an adhesive (either permanent, removable, renewable or permanently tacky), a clip, screws, magnets, an electrostatic surface, hook and loop material, detents, clasps, pockets, fingers or bosses may be used to secure an object against a flat panel or within a depression formed in a panel. That is, small bosses projecting into the opening at the edges of such a depression may retain an object against falling out, yet a user may remove the object by applying a slight force. Likewise, fingers can rotate to secure an object on a panel or in a depression thereof.

The accessory is also selectively, reversibly positionable on each of two sides of the retainers of an open binder. Without the computer or other object attached to it, the first surface is visible to a user when positioned on the first of the two sides. By positioning the aperture near the top of the binder instead of the bottom, the first surface is visible to a user when the insert is positioned on the second of the two sides of the open binder.

For a loose-leaf binder having a plurality of retainers disposed along the length and proximate the spine thereof for retaining loose leaves of paper, accessories and the like, the invention is an insert, another loose leaf. The insert comprises a panel having a first surface extending away from a first edge positioned proximate the spine of the binder to a second edge spaced away from the first edge. A rib having a length and a thickness is secured to the first edge, the thickness extending normal to the first surface of the panel and extending to an edge of the rib. An inside surface of the rib extends away from the first surface of the panel toward an edge of the rib. A first tab is movably secured to be selectively positionable along the length of the rib. The first tab is provided with a perforation for receiving one retainer of the plurality of retainers therethrough.

The insert also comprises a second tab movably secured to be selectively positionable along the length of the rib. The second tab is also provided with a perforation for receiving another retainer of the plurality of retainers therethrough. In one embodiment, the second tab is fixed with respect to and extends away from the first edge of the panel. The second tab in this embodiment is perforated to receive a second retainer of the plurality of retainers. Thus the second tab positions the panel longitudinally with respect to the binder. The second tab has a longitudinal dimension less than the twice the distance between adjacent rings in the binder. Thus the second tab fits any ring without interfering with any other ring.

The attachment mechanism, whether comprised of a slot and perforation formed between the rib and the panel (although the entire insert may also be referred to as a panel), multiple, positionable, perforated tabs or a single, perforated, fixed tab combined with slidable, adjustable, perforated tabs could be made integral to an accessory. Moreover, the attachment mechanism may be made removable or stowable with respect to the accessory.

In one embodiment, the rib has a cross-section fitted snugly against the first tab to be selectively moveable with respect thereto against the force of friction therebetween. In an alternate embodiment, first teeth are disposed along the rib to be engageable to second teeth disposed on the first tab for selectively positioning the first tab longitudinally along the rib.

"Binder" as used herein means any of a variety of book-like devices, typically having a front and back cover, but having retainers for securing page-like leaves by penetrating through perforations made in the leaves for the purpose.

"Leaf" as used herein means any item configured to be selectively removable from the retainers of a loose-leaf-type binder. Leaves are moveable within a binder, typically by lifting from one side to another.

"Panel" as used herein means any elongate portion of material having a surface sized to receive and retain an object. Panels typically hold a computer or calculator in the preferred embodiment, but in alternate embodiments may contain pockets or printing. The panel may be regarded as the entire insert, having perforations, slots and tabs therein or may be regarded as the main usable part of the insert only, having a rib or tabs attached thereto for securing the panel in a binder.

A "Rib" indicates two different items. The first is the remaining portion of the insert or panel after a slot is cut away along the inside edge of the panel. The second is a transversely thickened section of material attached to an inside edge of the panel to form a rail for retaining a slide moveable therealong in the longitudinal direction of the panel. The rib and panel may be of similar, identical or different materials. They may be part of the same object or be different objects as discussed above.

In the first configuration, the rib is a section of the original stock of the panel and is thus formed of material identical to the material in the panel. However, the rib is separated from the panel by a slot. That is, the insert is formed of a single sheet of material (stock) which is then perforated with a single circular hole near the lower inside corner (as viewed installed in a binder by a user) and an elongated slot just outward with respect to the spine inboard of the binder, toward the panel with respect to the inside edge of the sheet of stock. The slot extends almost the entire length of the sheet and thus separates the rib of stock from the panel of stock. Alternatively, the rib is formed from the inside edge of the panel, that is, to form the inside edge of the overall panel.

"Web" as used herein means a section of material, preferably of a base material and extending away from a panel of the base material to secure another piece to the panel. A web is also the material left behind connecting one section of a piece of material to the remaining section of the piece of material when all other intervening material is cut away. For example, a slot cut along a piece of material creates two pieces, one on either side of the slot, connected by a web at each end of the slot, where there was originally a single piece of material.

"Plastic" as used herein means a polymeric material whether reinforced or not, whether solid or latticed, whether a single piece or fabricated from multiple pieces, whether expanded, drawn, extruded, pultruded, stretched, cast or rolled, and whether thermoformed or thermoset. Plastics of interest for fabrication of the insert are from the vinyls, polyolefins, nylons and the like. Also considered as suitable materials are the polyethylene terephthalates such as Mylar™ and fabrics, whether natural or synthetic. In some embodiments, polystyrene-based polymers, particularly acetylbutadiene styrene (ABS), and other crack-resistant compounds are desirable.

"Stiff" as used herein means that the insert is sufficiently rigid that a computer may be attached and disattached with ease. More importantly, the rib captured by the retainers must be sufficiently stiff to hold the inside edge of the panel proximate the retainers. The rib ideally performs as a rigid bar fitting on one side of the retainers and attached at each end to the panel by webs to keep the panel in close proximity to the retainers. In practice, a rib could be made of metal or reinforced with metal to provide near-rigid stiffness. In the alternative, a sufficient width of plastic material must be provided in the rib to establish a cross-section having the required stiffness. In one embodiment, a thin, stainless steel panel is possible. The thinness would provide some flexibility, while the dimensions in the plane of the panel would provide stiffness.

"Flexible" as used herein means that the panel is capable of being warped under load without cracking or otherwise losing structural integrity. Large displacements of the panel material, such as in bending, are not always intended, but rather tolerated in the course of use. On the other hand, pockets and holders for photographs, business cards and credit cards are intended to be highly flexible and transparent in use. Vinyl products including vinyl and polyvinylchloride and various olefinics such as polyethylene and polypropylene may be flexible, whereas styrene is rigid and likely to crack when bent or otherwise flexed. Thus, a panel becomes much more robust in use if made of one of the flexible, plastic materials capable of tolerating distortions, particularly bending transverse to the plane of the leaf.

"Reversible" as used herein means that the panel may be inserted into a binder so that its surface of interest is presented on the left side of an open binder or on the right side of the open binder.

"Hook and loop material" is actually mating pieces of two materials. The loop material is typically woven to be integral to a fabric backing to create a pile of closed loops of very strong, durable thread standing out from the front surface of the fabric. The back surface of the fabric is flat. The hook material is formed as an array of J-shaped hooks extending from a front surface of a plastic sheet. The back surface of the sheet is flat, containing no hooks.

In use, the sheet of hook material is secured by its back surface to an object. A layer of loop material is bonded by its back surface to a base. When the object is placed on the base, the hooks on the object engage the loops on the base. To release the object, a user must pull the object away from the base until the hooks begin to straighten elastically, releasing the loops. Upon releasing the loops, the hooks return elastically, with no permanent distortion, to their original "J" shape. Hook and loop material is widely available and is available under the trademark Velcro™.

"Computer" as used herein includes calculators and all types of computational devices. Computing power, usually identified by speed and memory, of computers is continually being expanded while the space envelope is continuing to shrink. Thus, little benefit results from trying to distinguish computers from calculators or other microprocessor-based accessories as to the instant invention. Thus, the invention is equally useful for all such accessories.

"Vertex" as used herein means a corner or the like, although the corner may have a very large radius. Thus, the vertex is defined by two line segments at their point of intersection. However, proximate such a vertex is the actual corner of material defined by the junction of two of the edges of the material.

An "Arbitrary distance" as used herein indicates the distance between a first retainer and at least one second retainer captured within the perforations in a panel of the accessory of the invention. The arbitrary distance is arbitrary because it is not selected by a user, nor by the designer of the accessory or of the invention. Rather, the arbitrary distance is any distance within reach of an elongate slot in the panel of the invention. Thus any spacing of retainers is accommodated by a single circular perforation, positioned near one corner of the panel for capturing a first retainer, and an elongate slot extending along the panel to include every retainer positioned between the proximal and distal ends of the slot. Thus, as to the panel, the retainer closest to the distal end of the slot is positioned some arbitrary distance away from the first retainer engaged by the circular perforation near the proximal end of the slot. The panel is penetrated and retained by the retainers regardless of the spacing between the first and second retainers, which spacing can be arbitrary without affecting the retention of the panel of the accessory. An alternate embodiment would place a perforation near the middle of the insert (leaf) with slots extending toward each end therefrom. However, a perforation at one corner is more likely to fit universally the retainer arrangements of various binders.

"Friction" as used herein indicates the frictional forces acting to prevent slip between two surfaces held together with a force normal to the surfaces. In one preferred embodiment, tabs grip against a rib associated with the panel of the insert of the invention. The tabs can be slipped with respect to the rib by application of force by a user. However, in normal use, the frictional force existing between the mutually contacting surfaces of the tab and the rib is sufficient to prevent relative motion therebetween.

The word "Teeth" as used herein identifies a series or rank of tooth-like projections extending away from a first surface to interfere with a second surface or with corresponding tooth-like projections on a second surface. Such interference arrests any relative motion between the surfaces. Relative motion occurs only when a user applies sufficient force along the rank of the teeth to distort them sufficiently to permit relative motion. Relative to the surface from which they project, some teeth may be ramped on one side and normal on the other, to permit easy distortion and to prevent it, respectively. Such teeth result in a ratchet effect. A lever accessible to a user may be used to lift a tooth on one surface away from engagement with corresponding teeth on another surface. Thus, the force required to move the teeth relative to one another may be reduced.

DETAILED DESCRIPTION OF THE DRAWINGS

Figure 3:
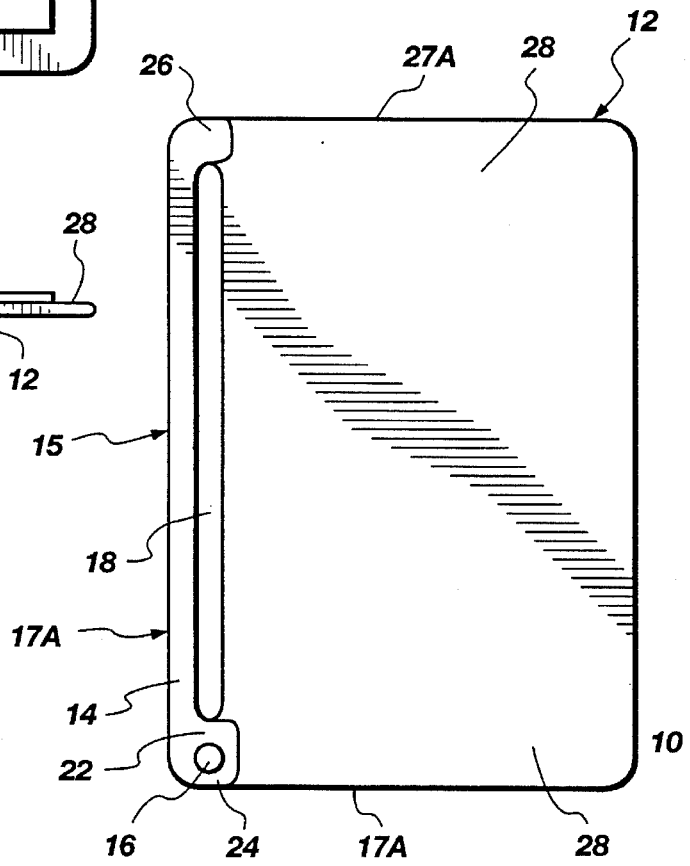
FIG. 3 is a top plan view of an alternate embodiment of the insert of the invention having a reinforcing stiffener.
Figure 4:
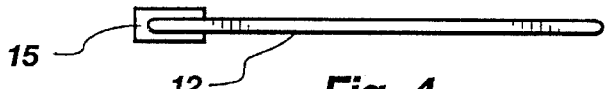
FIG. 4 is an end view of the insert of FIG. 3.

The invention is best understood by reference to FIGS. 1–4, wherein insert 10 is shown comprised of a panel 12 and a rib 14. The rib 14 may be stiffened with a stiffener 15, preferably of metal. A perforation 16 is formed near the vertex formed by the bottom edge 17A and left edge 17B of the insert 10. The perforation 16 in the panel 12 is sized to accept a retainer or ring from a loose-leaf binder as known in the art. The rib 14 is formed by removing the material from a slot 18 to create space for receiving additional rings from a loose-leaf binder. A securement structure 20 is attached to the panel 12 for holding an accessory such as a calculator or palm-sized computer. A first web 22 and second web 24 connect the rib 14 to the panel 12 after formation of the perforation 16 in slot 18. Similarly, a third web 26 connects the rib 14 to the panel 12 at the top edge 27A of the insert 10. The front surface 28 of the panel 12 may be left flat for printing information such as is contained in numerous data sheets used by various professions, as illustrated in FIG. 3. In the preferred embodiment, the securement structure 20 is a hook and loop material such as Velcro™ for removably connecting an object to the panel 12.

In the alternative embodiments illustrated in FIGS. 5–9, the rib 14 is part of a rail 30 formed separately from the panel 12 and attached thereto. The perforation 16 and slot 18 are formed in the rail 30 which is preferably manufactured of a strong, stiff material such as metal. In the preferred embodiment, the panel 12 should be made of a stiff but flexible material such as a durable plastic tolerating large distortions without cracking or fracturing.

Figure 5:
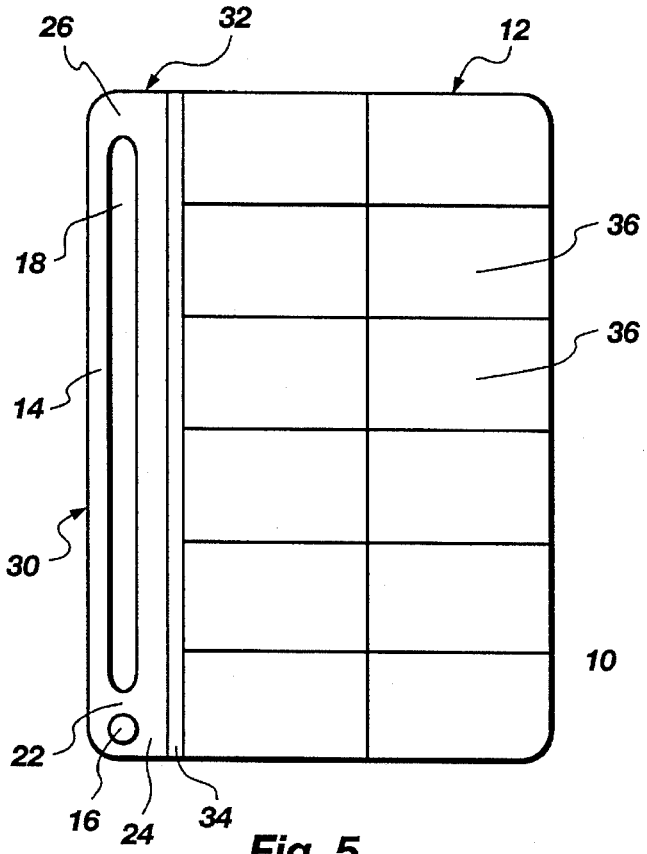
FIG. 5 is a top plan view of an alternate embodiment of the insert of the invention having a non-integral rail to hold the panel in a binder.
Figure 6:
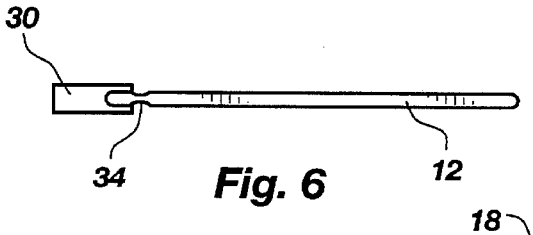
FIG. 6 is an end view of the insert of FIG. 5.

Although the rail 30 could be applied to any of the embodiments of the insert 10, it is shown in FIG. 5 connected to the panel 12 by a hinge 34 which may be merely a thinned section of the panel 12 to encourage flexibility, or a pinned rotating hinge as used in conventional hinge applications.

Figure 7:
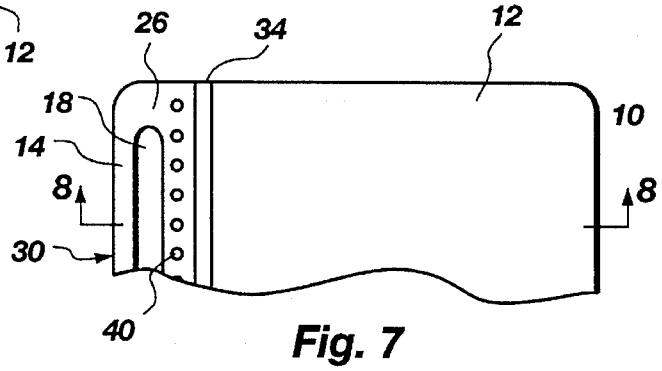
FIG. 7 is a top plan view of an alternate embodiment of the insert of the invention having a rail fastened by mechanical fasteners.
Figure 8:
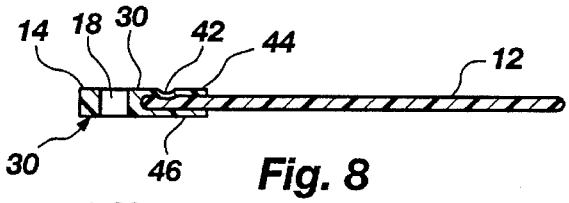
FIGS. 8 and 9 are end views of alternate embodiments of the insert of FIG. 7.
Figure 9:
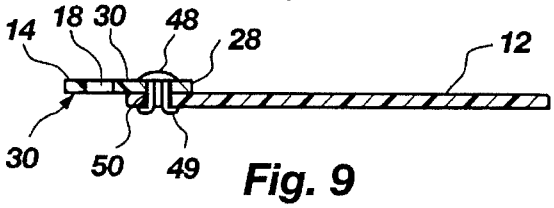

Also, the embodiment of FIG. 5 uses pockets 36 for holding various objects. Pockets 36 in inserts 10 adapted to be used in loose-leaf binders may be used to hold business cards, computer diskettes, credit cards and various other useful articles. In the embodiments of FIG. 7–9, the rail 30 is attached to the panel 12 by fasteners 40. The fasteners 40 shown in FIG. 7 may be mechanical dimples 42 formed in the top nib 44 of the rail 30 as shown in FIG. 8. In this embodiment, the frictional force created between the top nib 44 and the bottom nib 46 clamping against the panel 12 is augmented by the dimple 42 formed in the top nib 44 to create a more secure mechanical retention. Alternatively, the fasteners 40 of FIG. 7 may be the rivet heads 48 of FIG. 9 on the rivets 49. The rivet shank 50 penetrates the panel 12 to connect the rail 30 to the panel 12.

Figure 10:
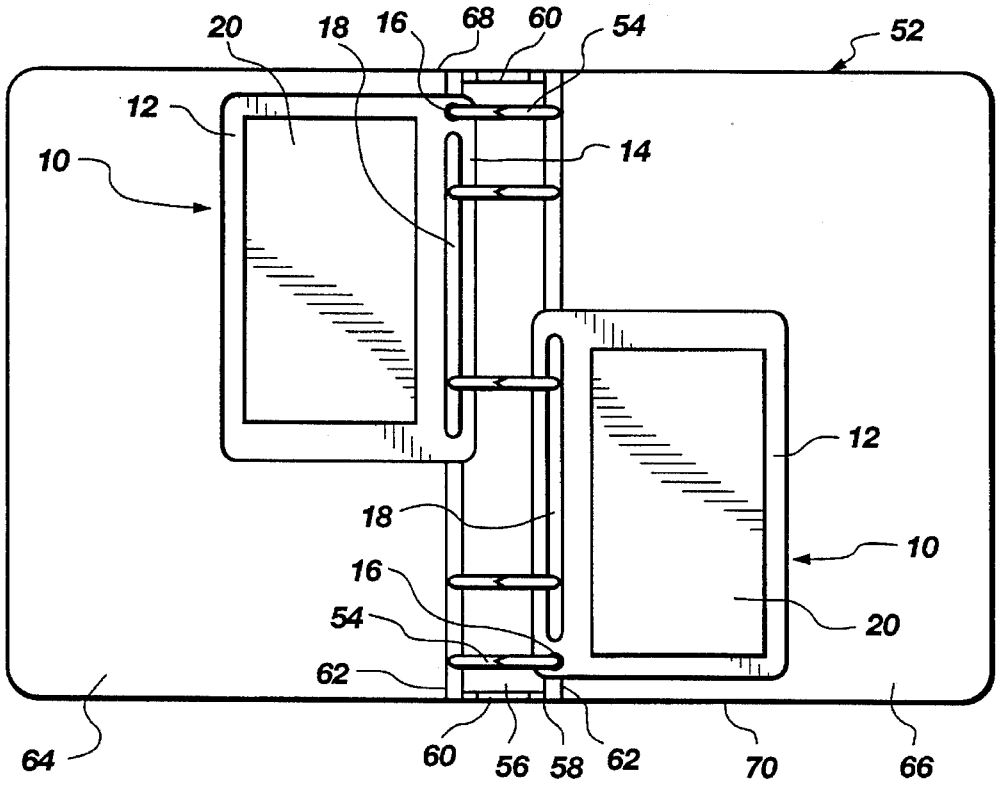
FIG. 10 is a top plan view of an open binder showing the insert of the invention attached in two different configurations to the rings of the binders.

The use of the insert 10 is demonstrated in FIG. 10 which shows a conventional binder, in this instance somewhat larger than the insert 10. Although the insert 10 may be used in a binder having leaves of the same size as the insert 10, with a variety of spacings and patterns for the rings 54. In FIG. 10, the binder 52 is a large 5-ring type.

As illustrated, the frame 56 holds the rings 54 and acts as a clamping mechanism. The frame 56 is connected to a back panel 58 of the binder 52 forming a spine of the binder 52. Typically, levers 60 operate to open and close the rings 54 in the frame 56. The hinges 62 on the binder 52 are typically thin plastic connectors but may also be mechanically pinned hinges as known in the art. The front cover 64 and back cover 66 are connected to the back panel 58 by the hinges 62.

The inserts 10 can be fit into the binder 52 in a variety of positions. Illustrated proximate the top end 68 and the bottom end 70, the inserts 10 can be positioned to be useful proximate the front cover 64 or the back cover 66.

Thus, a user can work on other materials in the binder 52 while the insert 10 occupies a useful position leaving the other materials in the binder 52 accessible. For example, if the securement structure 20 holds a calculator, while a page of figures occupies the space proximate the back cover 66, then the insert 10 should be located proximate the front cover 64 near the top end 68 to be both accessible and out of the way of the page of figures.

Figure 11:
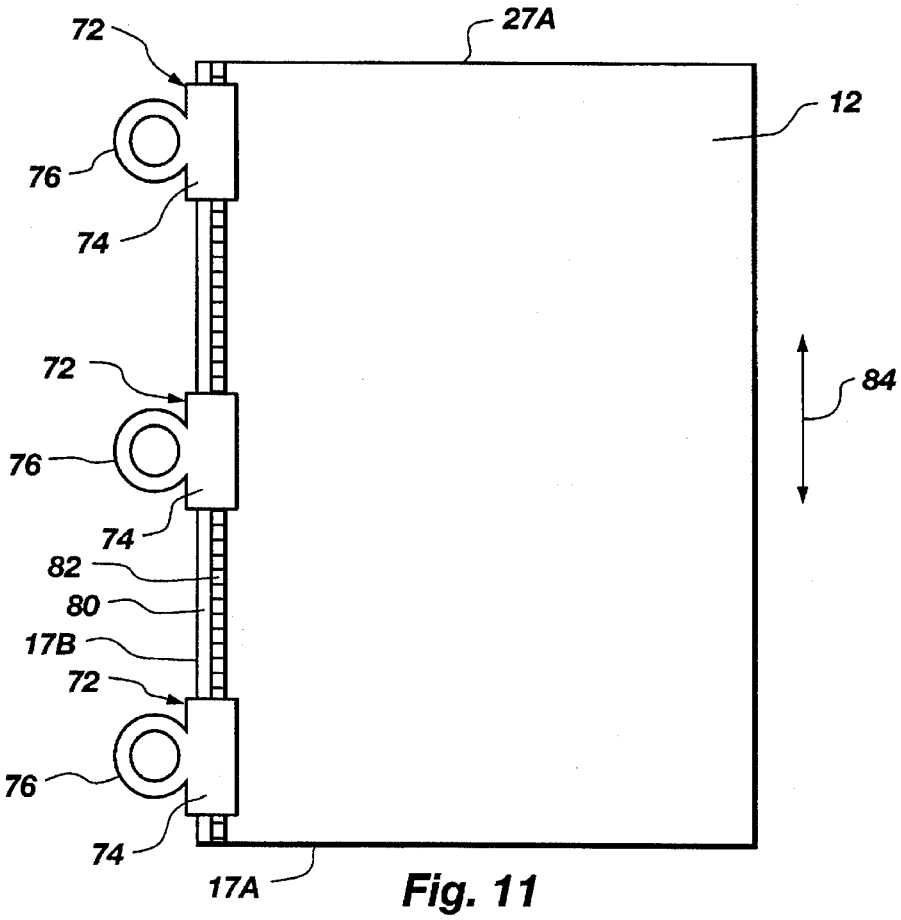
FIG. 11 is top plan view of an alternate embodiment of the invention using non-integral connectors sliding along a rib to hold the panel.

FIG. 11 shows an alternate embodiment of the insert of the invention having connectors 72, each comprised of a body 74 and a loop 76 forming an aperture 78 for retention by a ring 54 of the binder 52. In this embodiment, the connectors 72 are moveable along a rib 80 formed at the left edge 17B of the insert 10. A grip region 82 is positioned proximate the rib 80 for resisting motion of the connector 72 along the rib 80. Although the grip region 82 may be formed on the rib 80 itself, the preferred embodiment uses a grip region 82 disposed lengthwise in the direction 84. Alternate embodiments of the insert of FIG. 11 are shown in FIGS. 12–15.

Figure 12:
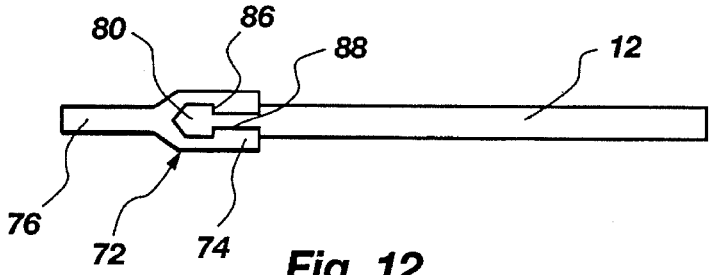
FIG. 12 is an end view of the insert of FIG. 11.

In the embodiment of FIG. 12, the steps 86 in the body 74 engage the rib 80 to prevent the panel 12 from moving away from the connector 72 and the rings 54 of the binder 52. The base 88 of the body 74 engages the panel 12 by friction, preventing motion in the lengthwise direction 84. The body 74 can be moved in the direction 84 by a user by application of force to overcome friction, but in service, the frictional forces between the body 74 and the panel 12 are sufficient to prevent relative motion therebetween.

Figure 13:
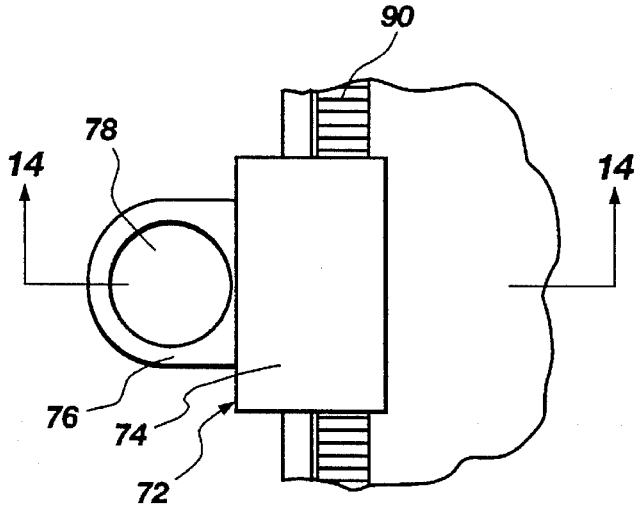
FIG. 13 is a top plan view of a portion of the insert and connector in one embodiment of the insert of FIG. 11.
Figure 14:
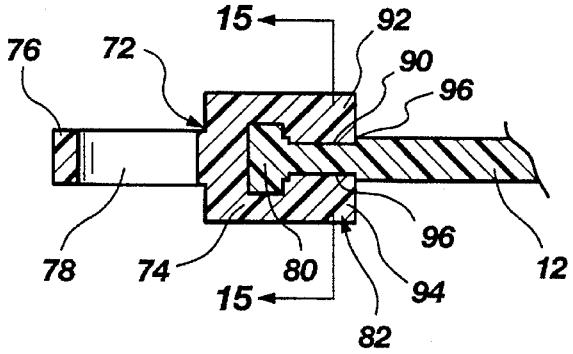
FIG. 14 is an end view taken at section 14—14 of the insert of FIG. 13.
Figure 15:
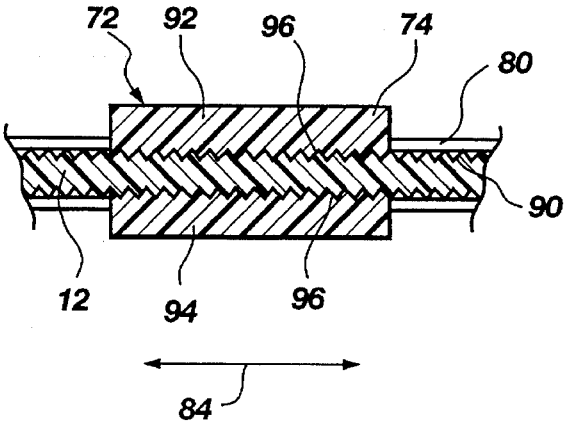
FIG. 15 is a side elevation cut-away view taken at section 15—15 of the insert of FIG. 14.

In the embodiment of FIGS. 13–15, the grip region 82 is provided with teeth 90. The upper jaw 92 and lower jaw 94 are likewise provided with teeth 96 which engage the teeth 90. The mechanical resistance to motion in the direction 84 of the connector 72 with respect to the panel 12 can be overcome by a user forcing the connector 72 to move with respect to the panel 12. The spring force in the body 74 holding the upper jaw 94 close to the lower jaw 94 must be overcome by a user to move the teeth 90 with respect to the teeth 96. Thus, in service, a mechanical detention exists between the teeth 96 and the teeth 90.

Figure 16:
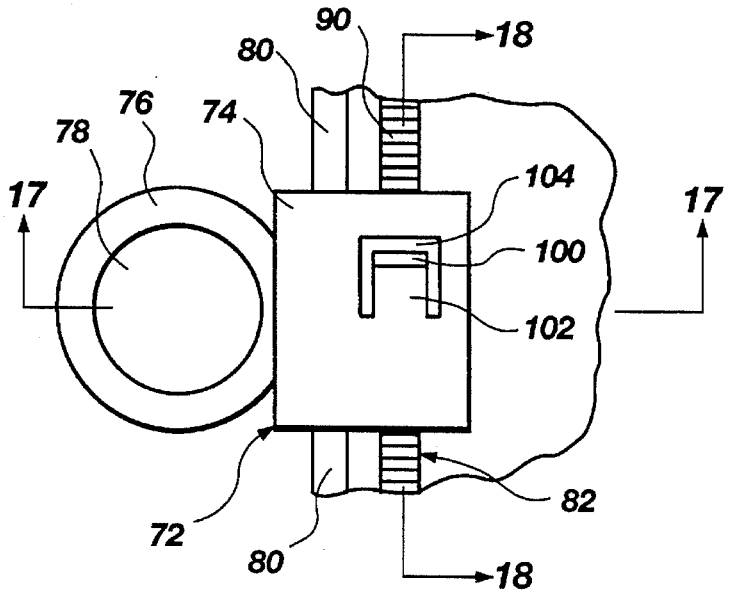
FIG. 16 is a detailed top plan view of a portion of one embodiment of the insert of FIG. 11.
Figure 17:
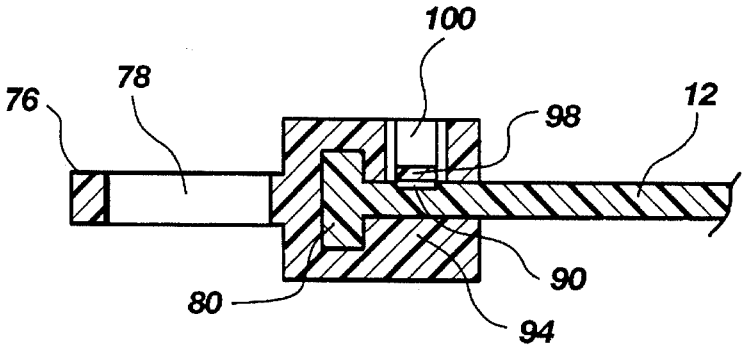
FIG. 17 is a end sectional view of the insert of FIG. 16 taken at section 17—17.
Figure 18:
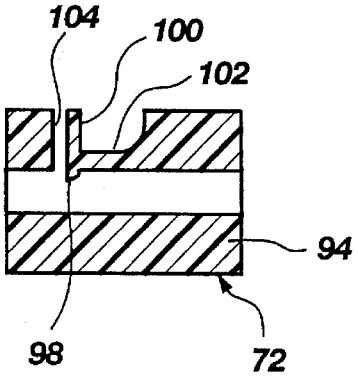
FIG. 18 is a side cut-away elevation view of the insert of FIG. 16 taken at section 18—18.

In the alternative embodiment of FIGS. 16–18, a single tooth 98 may replace the teeth 96. Similarly, the tooth 98 may actually be comprised of several teeth 96. A lever 100 is operable to tilt the tooth 98 away from the teeth 90 on an arm 102, which is made to be flexible. A pencil or fingernail inserted into the gap 104 operates the lever 100 to disengage the tooth 98 from the teeth 90 in the grip region 82. Thus, the tooth 98 is positively and selectively engageable with respect to the teeth 90. In this embodiment, the connectors 72 can be positively moved and stopped at will to position them along the panel 12 to match any retainer (ring 54) spacing in any binder 52.

Figure 1:
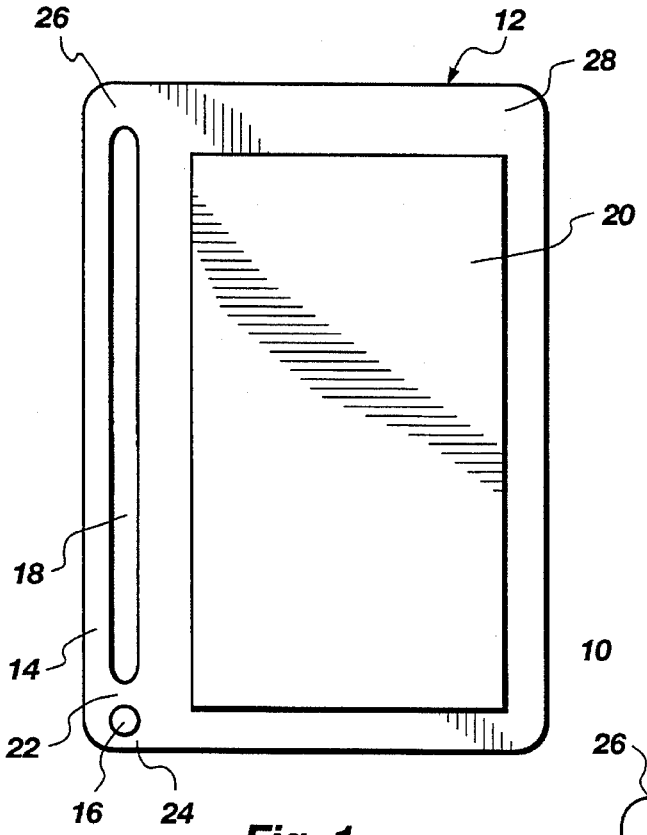
FIG. 1 is a top plan view of the insert or leaf of the invention.
Figure 2:
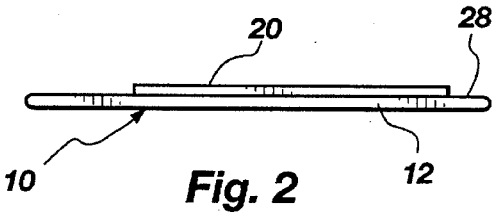
FIG. 2 is an end view of the insert of FIG. 1.
Figure 19:
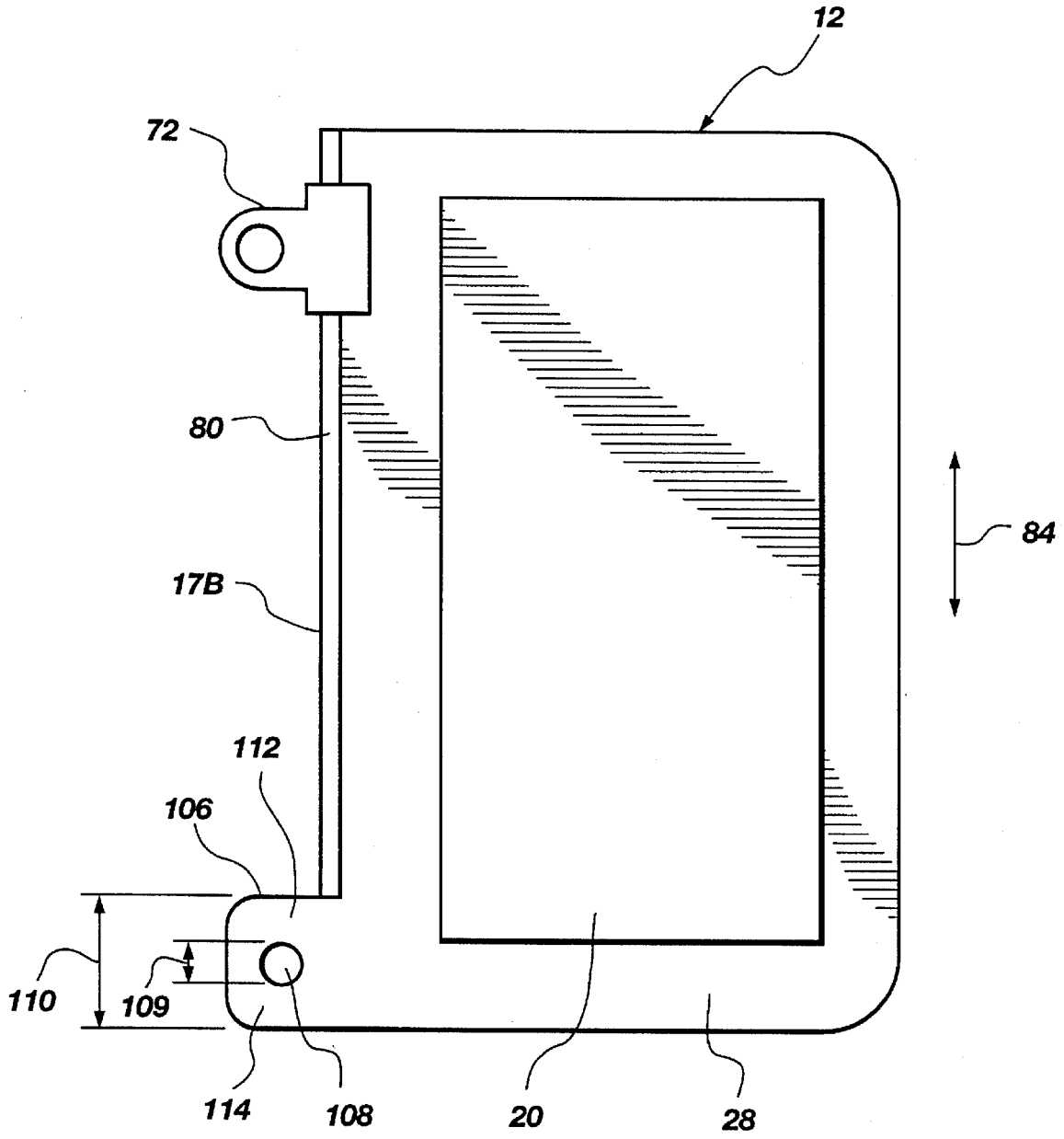
FIG. 19 is a top plan view of an alternate embodiment of the invention having a perforated tab formed integrally with the panel at one end, and movable connectors along a rib to adjust for different retainer spacings in a binder.
Figure 20A:
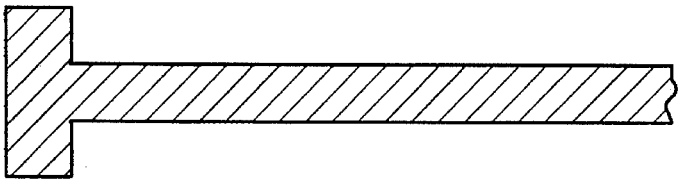
FIGS. 20A–F are partial, cut-away end views of the rib embodiments applicable to the insert of FIG. 11.
Figure 20B:
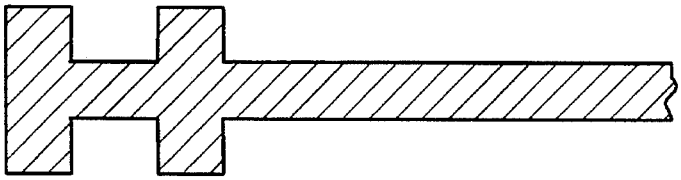
Figure 20C:
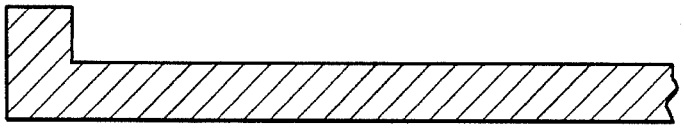
Figure 20D:
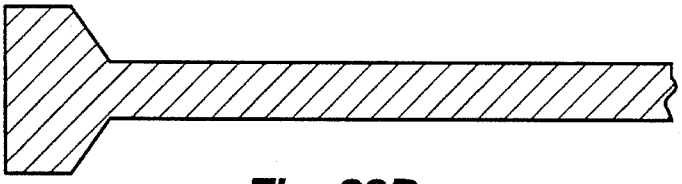
Figure 20E:
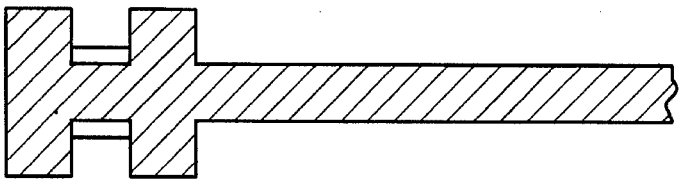
Figure 20F:
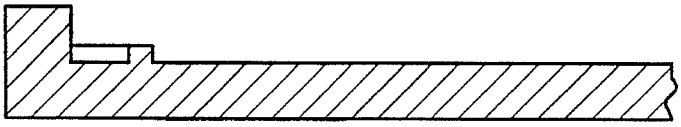

FIG. 19 illustrates an alternative embodiment combining the features of the inserts 10 of FIGS. 1 and 11. In the embodiment of FIG. 19, a tab 106 is formed integrally on the panel 12 to extend from the left edge 17B. The tab 106 is provided with an aperture 108 having a diameter 109 sized to receive a ring 54 of the binder 52. Similarly, the length 110 of the tab 106 is sized to fit between the rings 54. A first web 112 and second web 114 remain after perforation of the tab 106 to form the aperture 108. The connector 72 is attached to slide along the rib 80 as described in the previous embodiments.

Several connectors 72 may be attached to the rib 80. In this embodiment, the various mechanisms to prevent movement of the connector 72 with respect to the panel 12 can be employed. However, no such mechanisms are required. The tab 106 has the effect of fixing the panel lengthwise with respect to the rings 54 of the binder 52. Thus, the connectors 72 need only secure the panel 12 against movement away from the rings, and not movement in the direction 84.

Figure 21:
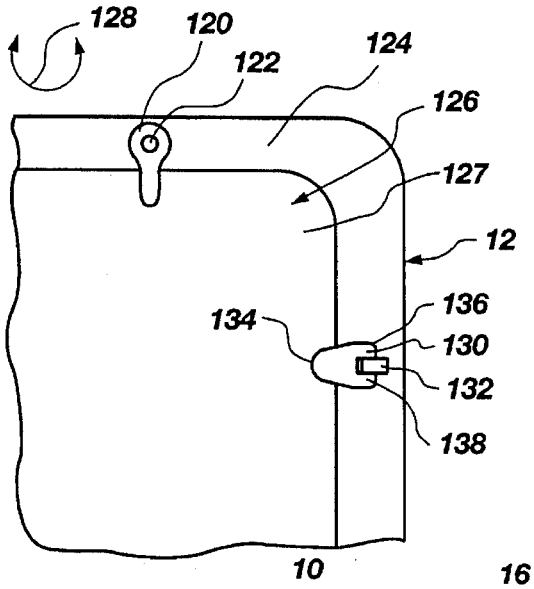
FIG. 21 is a top plan view of a portion of the insert of the invention illustrating rotatable fingers as a securement mechanism.

In the embodiment of FIG. 21, a finger 120 on a pivot 122 is attached to the border 124 surrounding a depression 126 in the panel 12 formed by the depressed panel 127. The finger 120 is rotatable in the direction 128 to engage or disengage an object held within the depression 126 of the insert 10. Alternatively, a tab 130 captured by a clasp 132 may be used. The tab 130 can be lifted by its front end 134 to pivot about its back end 136 to release an object held within the depression 126. A bar 138 of rectangular cross-section is formed near the back end 136 of the tab 130 to provide a resistance to opening.

Figure 22:
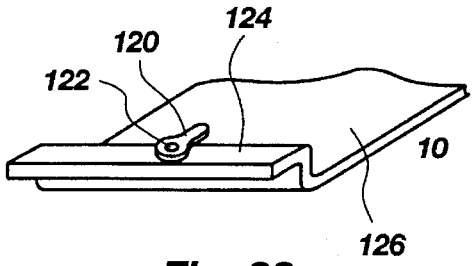
FIG. 22 is an isometric view of a portion of the insert of FIG. 21.

Although the insert 10 of FIG. 22 illustrates a substantial difference in the positions of the border 124 and the depressed panel 127, the tab 130 or the finger 120 could be made to rise above the panel 12 a distance to permit the panel 12 to secure an object against a flat surface.

Figure 23:
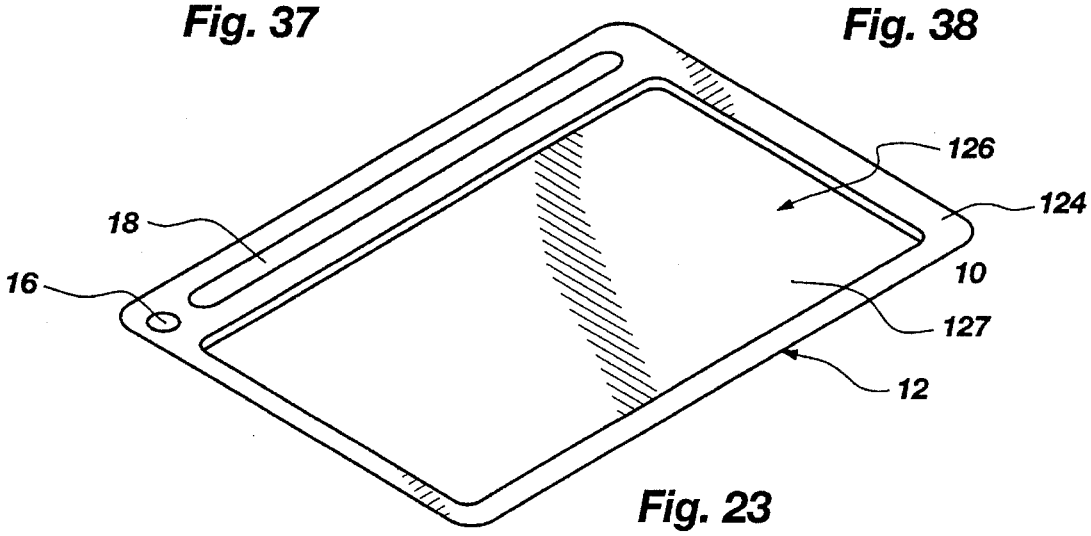
FIG. 23 is an isometric view of the insert of the invention having a depression formed in the panel for receiving a useful objection such as a calculator, computer, etc.

FIG. 23 illustrates the preferred embodiment of the insert 10 having a depression 126 for receiving a useful object such as a computer or calculator.

Figure 24A:
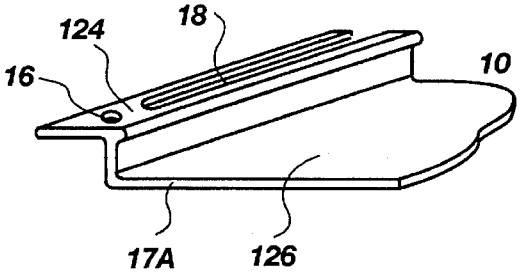
FIG. 24A is an isometric view of a portion of the insert of the invention of FIG. 23 having a depression for receiving a useful object, and a detent for maintaining the object in the depression.
Figure 24B:
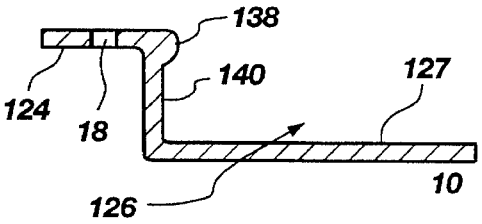
FIG. 24B is a partial cross-sectional view of one embodiment of the detent of FIG. 23 using a boss as the detent mechanism.
Figure 25:
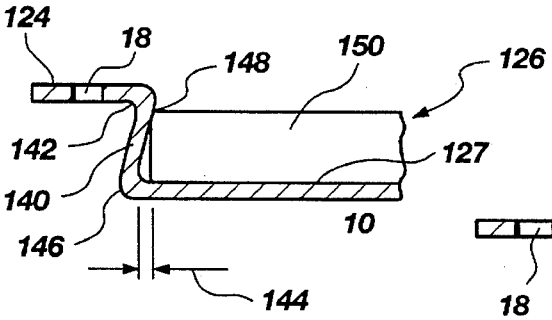
FIG. 25 is a partial cross-sectional view of the insert of FIG. 23, this one an embodiment in which the detent mechanism is an undercut depression leaving a detent at the opening of the depression.
Figure 26:
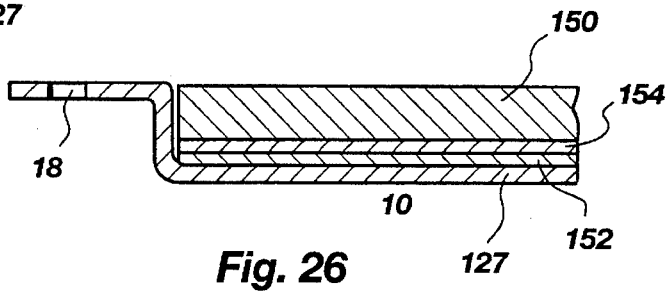
FIG. 26 is a cross-sectional end view of a portion of the insert of the invention showing electrostatically attractive materials surfacing the depression of the panel and the computer.

In the embodiment of FIGS. 24A–25, the depression 126 may extend to the bottom edge 17A. In the configuration of FIG. 24A, the depression 126 can be formed in an extruded sheet that can be cut to lengths. Nevertheless, an alternate embodiment would employ the depressed panel 126 surrounded on all sides by the border 124 as shown in FIG. 23.

The embodiments of FIGS. 24B and 25 apply equally well to the configuration of FIGS. 24A and 23. That is, the boss 138 at the corner formed by the wall 140 and the border 124 may be located periodically around the wall 140, or may be a continuous member, along the entire wall 140. By contrast, the lip 142 of FIG. 25, located similarly to the boss 138 of FIG. 24B, results from an undercut distance 144 by which the lip 142 extends beyond the vertex 146 formed by the depressed panel 127 and the wall 140. Thus, the corner 148 of the object 150 contacts the lip 142, retaining the object 150 within the depression 126 formed by the wall 140 and the depressed panel 127.

An alternate means for attachment of the object 150 to the depressed panel 127 is by means of an electrostatic sheet 152 attached to the depressed panel 127 with a matching electrostatic sheet 154 attached to the back of the object 150. Each of the electrostatic sheets 152, 154 may be fabricated of a plastic dielectric material such that the sheets 152, 154 adhere to one another upon contact.

Figure 27:
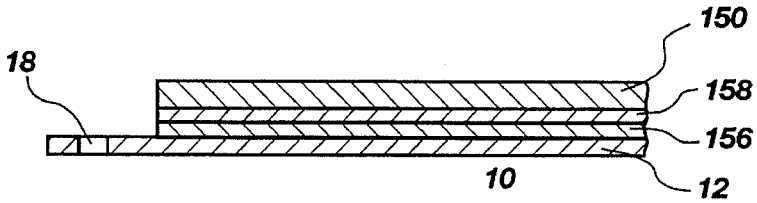
FIG. 27 illustrates a cross-sectional end view of a portion of the insert of the invention having electrostatically-attractive surfaces attached to a computer and to a flat panel of the insert of the invention.

In an alternate embodiment, the panel 12, as seen in FIG. 27, has no depression 126, but instead has a rubberized magnet 156 attached thereto. Another rubberized magnet 158 is secured to the object 150. By configuring the rubberized magnets 156, 158 to have opposite magnetic poles in contact, a strong magnetic bond holds the object 150 proximate the panel 12.

Figure 28:
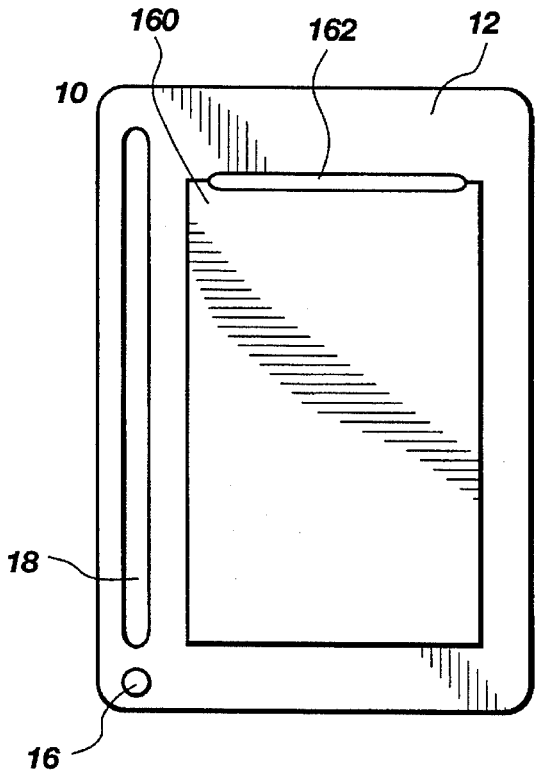
FIG. 28 is a top plan view of an insert of the invention having a slot for receiving a clip attached to an object such as a computer to secure the computer to the insert.
Figure 29:
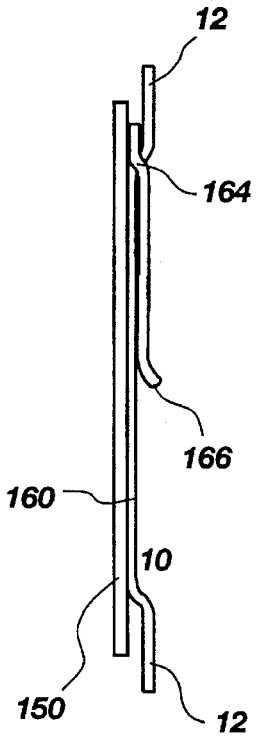
FIG. 29 is a cut-away side elevation view of the insert of the invention of FIG. 28 having a computer attached thereto by a clip.
Figure 30:
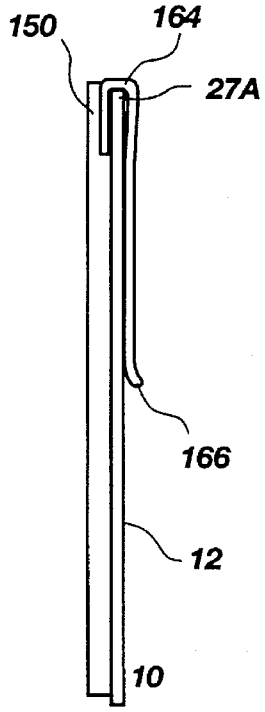
FIG. 30 is a cross-sectional side elevation view of a flat insert having a computer secured thereto by a clip over the top of the insert.

FIGS. 28–30 illustrate yet another embodiment of the insert 10, having an embossed panel 160 at the top of which an opening 162 is formed for receiving a clip 164 attached to the back of the object 150. The clip 164 fits through the opening 162, extending at its distal end 166 to a position behind the embossed panel 160. In a related embodiment, the panel 12 of FIG. 28, being completely flat and lacking the embossed panel 160 and opening 162, is configured to receive a clip 164 as shown in FIG. 30. In this embodiment, the clip 164 extends over the top edge 27A, with the distal end 166 extending behind the panel 12 to hold the object 150 thereagainst.

Figure 31:
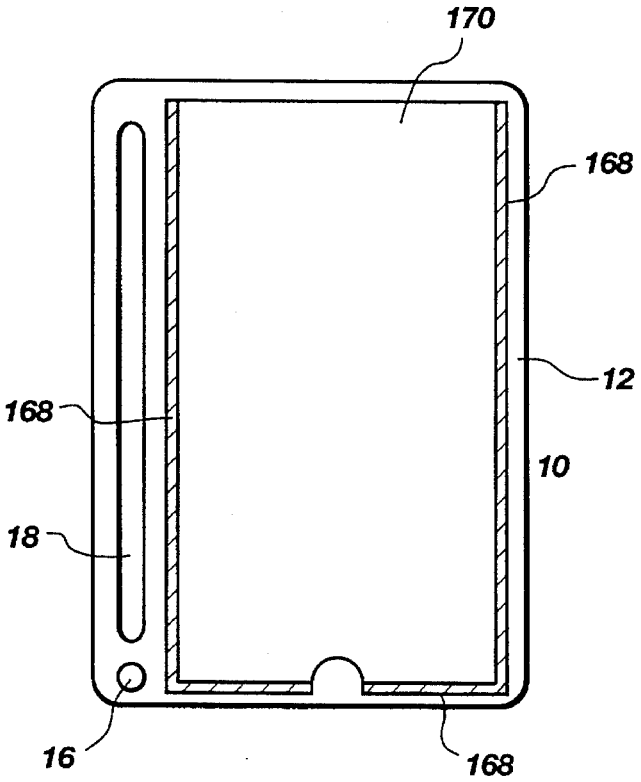
FIG. 31 is a top plan view of an insert of the invention having a pocket bonded to the panel.
Figure 32:
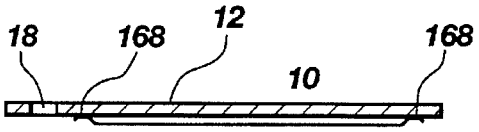
FIG. 32 is a cross-sectional end view of the insert of FIG. 31 showing a pocket of flexible material in close proximity to the panel.
Figure 33:
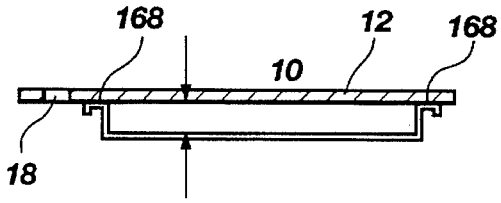
FIG. 33 is a cross-sectional end view of the panel of FIG. 31 in an alternate embodiment having a pocket formed to stand off from the panel.

In FIG. 31, a seam 168 bonds a pocket 170 at three sides thereof to the panel 12. The seam 168 may be formed by a simple heat-bonding process, glue, fasteners, sewing, or other means similarly calculated to secure the pocket 170 to the panel 12. The embodiment of FIG. 32 illustrates a pocket 170, which may be of a flexible material fitting close to the panel 12. By contrast, the embodiment of FIG. 33 illustrates a pocket 170, which may be made of a flexible material or a firm but flexible material, having a standoff distance 172 between the pocket 170 and the panel 12 for receiving a useful object 150. The pocket 170 may be formed of a material that is sturdy enough to secure the object 150 therein, but flexible enough that buttons, such as those on a computer, could be accessed by touching the proper position on the pocket 170. Otherwise, the pocket 170 could be perforated to provide access to a panel of buttons or individual buttons.

Figure 34:
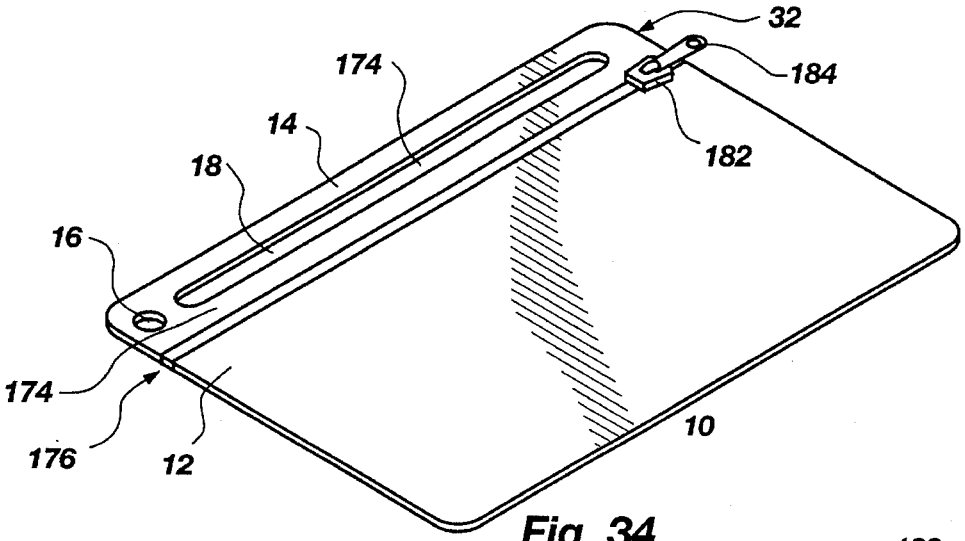
FIG. 34 is a perspective view of an insert of the invention having a separable interface between the panel portion and the attachment portion of the insert.
Figure 35:
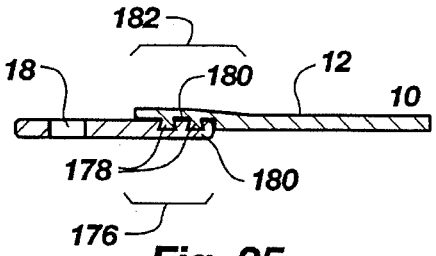
FIG. 35 is a cross-sectional end view of a portion of the insert of FIG. 34.
Figure 36:
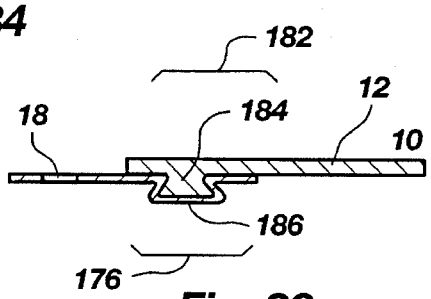
FIG. 36 is a cross-sectional end view of a portion of an alternate embodiment of the insert of FIG. 34.

FIGS. 34–36 illustrate embodiments calculated to make a panel 12 completely removable from an attachment bar 32. The attachment bar 32 includes the rib 14, aperture 16, slot 18 or other mechanisms to serve their functions. However, along a second rail 174 is formed or secured an engagement portion 176. The engagement portion 176 is provided with a plurality of dovetails 178 and receivers 180.

In this embodiment, the engagement portion 176 should be formed of a material that is sufficiently flexible to allow the dovetails 178 to be forced transversely into the receivers 180 with a slight amount of distorting pressure by a user. Nevertheless, the dovetails 178 are retained by the receivers 180 absent removal by a user. In one embodiment, a zipper pull 182 drawn by a tab 184 as illustrated in FIG. 34 could be used to close the dovetails 178 into the receivers 180.

Alternatively, the engagement portion 176 could be overlaid with the engagement portion 182 of the panel 12 and the dovetails 178 could be fitted into the receivers 180 with slight application of localized force. In the embodiment of FIG. 36, a single, large dovetail 184 is fitted to a single receiver 186. The dovetail 184 can be operated similarly to the dovetails 178 in the embodiment of FIG. 35, but may be slid longitudinally into one end of the receiver 186.

In each of the immediately-foregoing embodiments, the dovetails 178, 184 can be located on either the engagement portion 176 or the engagement portion 182. Similarly, and reciprocally, the receivers 180, 186 can be located on the engagement portions 176 or 182. Of course, the receiver 186 could be formed of a sheet metal, thereby exerting a clamping force on the dovetail 184. In any event, flexibility would be required in the engagement portions 176, 182 to the extent necessary to effect secure engagement.

Figure 37:
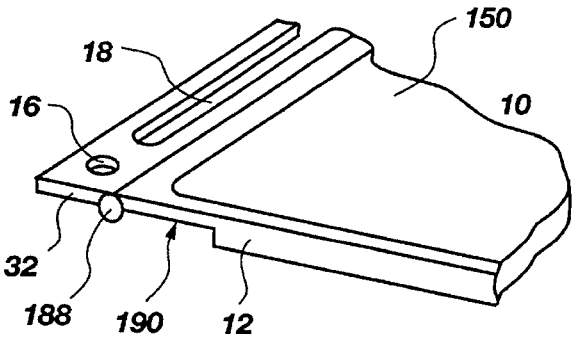
FIG. 37 is an isometric view of a portion of an alternate embodiment of the insert of the invention having a hinge connecting the attachment mechanism to the panel.
Figure 38:
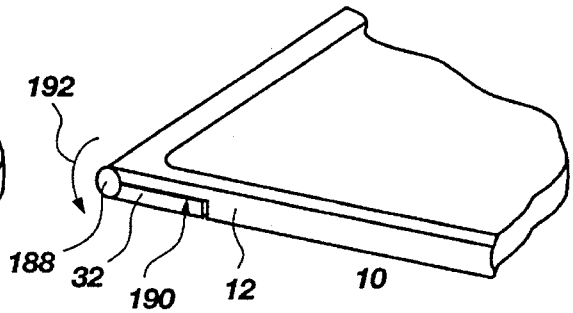
FIG. 38 is an isometric view of a portion of the insert of FIG. 37 showing the attachment portion folded into a stowed position under the panel.

In the embodiment of FIGS. 37–38, the attachment bar 32 is secured by a pinned hinge 188. A shelf 190, formed in the panel 12 to extend along the length thereof, receives the attachment bar 32 when rotated in the direction 192. Thus, the attachment bar 32 is deployed as illustrated in FIG. 37 and stowed as illustrated in FIG. 38 by a simple rotation of the attachment bar 32 into the shelf 190 formed in the panel 12. The configuration of FIGS. 27–38 is particularly adaptable where the panel 12 is integral with the object 150 located thereon or therein. That is, the panel 12 could be formed as the frame or case of a computer or other accessory. In such an event, the insert 10 becomes the entire computer or accessory employing the attachment scheme of the invention for securement in a binder.

The embodiments illustrated herein are by way of example and in no way limit the scope of the invention. Obvious variations will be apparent to those skilled in the art without departing from the invention. The invention is thus limited only by the claims.

What is claimed is:

1. An insert for a looseleaf binder of the type having a plurality of retainers disposed in a row along a length thereof proximate a spine to be selectively openable for receiving loose leaves, said insert comprising:

a panel for extending away from the plurality of retainers of the looseleaf binder, a surface of the panel having a securement structure for receiving and retaining an object;

a rib secured at a first end to a first edge of the panel by a first web positioned proximate one end of the panel and secured at a second end to the first edge of the panel by a second web positioned proximate another end of the panel to form a slot extending longitudinally between the first web and the second web and extending laterally between the rib and the first edge of the panel for receiving a first retainer of the plurality of retainers at an arbitrary longitudinal position;

a third web extending between the rib and the first edge of the panel to form an aperture positioned between the second and third webs, the aperture being sized to receive a second retainer of the plurality of retainers for positioning the panel longitudinally.

2. The insert of claim 1 further comprising a stiff material proximate the rib for resisting deflection laterally and for supporting a weight of an object secured to a surface of the panel.

3. The insert of claim 2 wherein the stiff material includes a metal formed to stiffen the rib laterally.

4. The insert of claim 1 further formed of a flexible material for tolerating distortion in a direction normal to the lateral and longitudinal directions without rupture.

5. The insert of claim 1 wherein the securement structure comprises a fastener for restricting movement of the object in at least two dimensions.

6. The insert of claim 1 wherein the securement structure includes a hook and loop material disposed on the surface for securing an object to the surface.

7. The insert of claim 1 wherein the panel is shaped to present a rectangular surface to a user and to present to a user an unobstructed face of an object secured to the rectangular surface.

8. The insert of claim 1 further including a surface having a recess formed in the surface of the panel to receive an object for providing to a user access to a face of the object away from the insert.

9. An insert for a looseleaf binder, said insert comprising:

a panel for fitting in a binder having a plurality of retainers aligned for penetrating a row of apertures in leaves adapted to receive the retainers, the panel having a first edge for extending along a first side of the plurality of retainers;

a rib secured to the first edge of the panel for extending along a second side of the plurality of retainers opposite the first side, the rib forming with the first edge a slot extending from a first end to a second end for receiving a retainer of the plurality of retainers at any position between the first end and the second end;

the panel further comprising a surface having a securement structure for receiving and retaining an object a first member securing the rib to the first edge proximate the first end; and a second member securing the rib to the first edge proximate the second end the second member being perforated to provide an aperture for receiving a second retainer of said plurality of retainers.

10. The insert of claim 9 wherein the insert has a longitudinal direction, the insert further comprising a registration member secured to the insert for positioning the insert with respect to the plurality of retainers in a longitudinal direction.

11. The insert of claim 9 wherein the rib further comprises a stiffener for retaining the panel proximate the plurality of retainers in a transverse direction extending away from the plurality of retainers.

12. The insert of claim 9 further provided with means for securing a flat surface of an object to a surface of the panel.

13. An insert for a looseleaf binder, the insert comprising:

a panel having a surface for positioning an object thereon, the surface having a securement structure for receiving and retaining the object;

a rib secured to the panel to form a slot between the panel and the rib, the slot having a length extending longitudinally along the panel for receiving at any position along the length a first retainer of a plurality of retainers oriented in a row in the looseleaf binder; and a registration member secured to the panel to receive a second retainer of the plurality of retainers therethrough for positioning the panel with respect to the first and second retainers.

14. The insert of claim 13 further comprising means for removeably securing an object to the surface of the panel.

* * * * *

UNITED STATES PATENT AND TRADEMARK OFFICE

CERTIFICATE OF CORRECTION

PATENT NO. : 5,597,256

DATED : January 28, 1997

INVENTOR(S) : Joseph D. Burton et al.

It is certified that error appears in the above-indentified patent and that said Letters Patent is hereby corrected as shown below:

On the title page, item [57],

In the Abstract, line 11, please delete "tings", and insert therefore -- rings --.

In the Abstract, line 12, please delete "tings", and insert therefore -- rings --.

In the Abstract, line 13, please delete "tings", and insert therefore -- rings --.

In the Abstract, line 14, please delete "ting", and insert therefore -- ring --.

In the Abstract, line 15, please delete "tings", and insert therefore -- rings --.

In the Abstract, line 17, please delete "ting", and insert therefore -- ring --.

In the Abstract, line 19, please delete "ting", and insert therefore --ring --.

In column 1, line 11, please delete "tings", and insert therefore -- rings --.

In column 1, line 19, please delete "tings,", and insert therefore -- rings, --.

In column 1, line 21, please delete "so, cured", and insert therefore -- secured --.

In column 1, line 27, please delete "ease", and insert therefore -- case --.

In column 1, line 27, please delete "tings", and insert therefore -- rings --.

UNITED STATES PATENT AND TRADEMARK OFFICE

CERTIFICATE OF CORRECTION

PATENT NO. : 5,597,256

DATED : January 28, 1997

INVENTOR(S) : Joseph D. Burton et al.

It is certified that error appears in the above-indentified patent and that said Letters Patent is hereby corrected as shown below:

In column 1, line 54, please delete "tom", and insert therefore -- torn --.

In column 2, line 15, please delete "dally", and insert therefore -- daily --.

In column 2, line 46, please delete "carded", and insert therefore -- carried --.

In column 2, line 53, please delete "tings", and insert therefore -- rings --.

Signed and Sealed this

Twenty-fifth Day of November, 1997

Bruce Lehman

*Attest:*

BRUCE LEHMAN

*Attesting Officer*

*Commissioner of Patents and Trademarks*